United States Patent [19]

Mormino

[11] Patent Number: 5,050,509

[45] Date of Patent: Sep. 24, 1991

[54] COMMERCIAL BURNING SYSTEM BURNING BOX

[76] Inventor: Sam Mormino, 3024 Palm La., Northbrook, Ill. 60062

[21] Appl. No.: 562,020

[22] Filed: Aug. 2, 1990

[51] Int. Cl.[5] ..... B09B 3/00; F23D 14/00

[52] U.S. Cl. ..... 110/235

[58] Field of Search ..... 110/235, 203, 251, 346, 110/297, 300; 98/36

[56] References Cited

U.S. PATENT DOCUMENTS

| | | | |
|---|---|---|---|
| 14,524 | 9/1924 | Stoddard | 110/235 |
| 2,642,826 | 6/1953 | Reynolds | 110/235 |
| 4,241,671 | 12/1980 | Joyner et al. | 110/235 X |
| 4,771,709 | 9/1988 | Applegate | 110/235 |
| 4,840,040 | 6/1989 | Fung | 98/36 X |

*Primary Examiner*—Edward G. Favors

*Attorney, Agent, or Firm*—Y. Judd Azulay

[57] ABSTRACT

An above ground enclosure for burning refuse including walls having vertically arranged tubes through which air from a manifold at one end of the tubes is circulated. A sheet of air is forced over the burning materials from a blower directing a stream of air from the vertically arranged tubes into horizontally arranged tubes pointing over the burning contents of the enclosure to cause a circulating drum-shaped rotating current of air over the burning material. The burning then can be done without letting smoke escape into surrounding areas.

3 Claims, 2 Drawing Sheets

COMMERCIAL BURNING SYSTEM BURNING BOX

BACKGROUND OF THE INVENTION

The present invention relates to refuse disposal methods and more particularly to methods of burning refuse without smoke escaping into surrounding areas.

For many years municipalities, counties and waste generators have disposed of waste by hauling it to a landfill for burial. This practice reduced the life of the landfill and incurred expensive transportation costs.

In many cases to preserve the life of the landfill, the various waste disposal companies have burned the waste. Such burning of material has caused large amounts of smoke as well as air pollution.

With the passage of air pollution legislation and with the increased awareness of the damage smoke and smoke debris can cause to the environment, it has become necessary to devise alternate safe methods of waste disposal.

Many different devices and methods have been proposed. However, those proposed methods have been expensive and either required large building to house the disposal means or bulky equipment. Thus, a small operator could not afford the cost of individual waste disposal. Even in those cases where cost would not be a problem, the space requirements for the disposal equipment could not be met.

There is a clear need for a waste disposal device and method that is affordable, fulfills strict environmental standards, achieves high efficiency performance and which can meet the space requirements of small waste disposers.

SUMMARY OF THE INVENTION

The present invention provides an above ground enclosure for burning waste and refuse which fulfills strict environmental standards, is affordable, has high efficiency performance and meets space requirements of small waste disposers. The above ground enclosure comprises a walled structure having at its base at least one horizontally arranged tube through which air from a manifold at one end of the tubes is circulated. A series of vertically arranged tubes emanate from the horizontally arranged tube to allow the air to rise into a second horizontally arranged tube pointing over the burning contents of the enclosure.

The invention also includes a means of keeping the vertical tubes cool during the waste disposal. The means includes the continued forcing of cool air from the horizontal tubes at the base of the enclosure up through the vertical tubes. In addition, a protective shield on the inside of the enclosure prevents heating of the vertical tubes.

Having the means for keeping the vertical tubes cool along with the continued air stream rising through the vertical tubes, causes a circulatory drum shaped rotating current of air over the burning material within the enclosure. This rotating current of air prevents the smoke from leaving the enclosure and allows efficient disposal of waste.

Other objects and advantages will appear in the course of the following description.

DESCRIPTION OF THE PREFERRED EMBODIMENT

Figure 1:
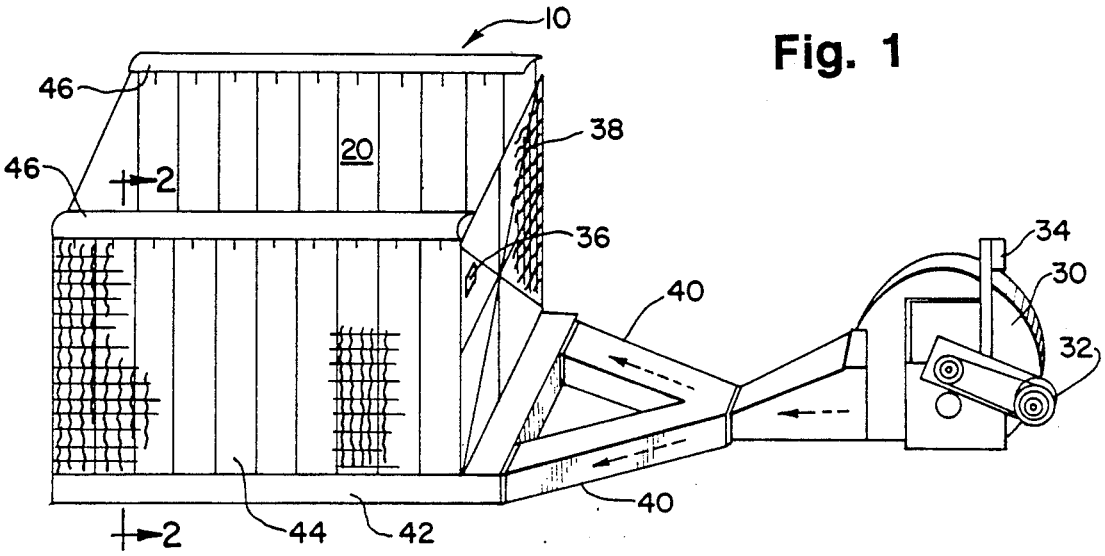
FIG. 1 is a perspective view of the refuse container of the invention.

FIG. 1 illustrates the refuse container 10 for burning waste material. The waste material is fed into the container 10 by either same being dumped or driven into the enclosed are 20 by any conventional method. The burned waste material ash may be removed from the enclosed area 20 by any conventional means.

At one end of refuse container 10 there is a blower 30 operated by a motor 32 controlled by control means 34.

The blower 30 blows air through air supply passages 40 into first horizontally arranged tubes 42 located at the base of and at least two opposite sides of refuse container 10.

Figure 2:
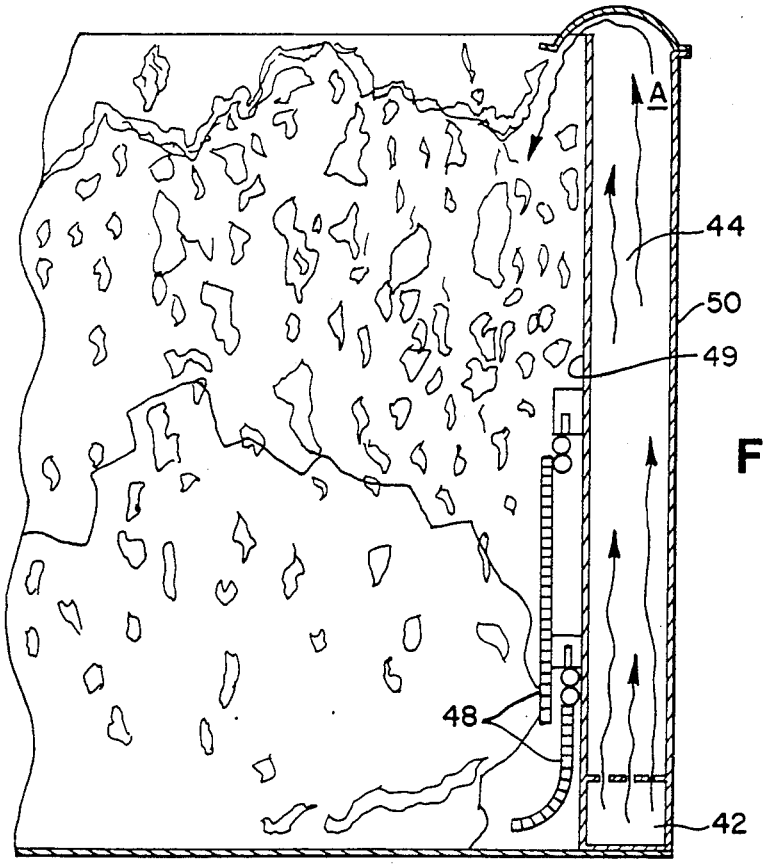
FIG. 2 is a transverse section taken along line 2—2 of FIG. 1.
Figure 3:
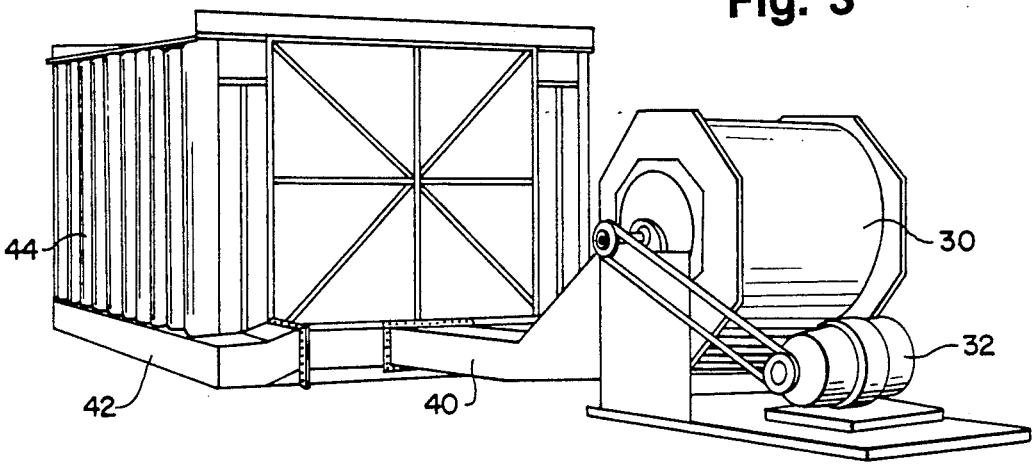
FIG. 3 is a side elevation view of the refuse container of the invention.

As illustrated in FIG. 2, the first horizontally arranged tubes 42 open at one side into a series of channels defining a plurality of vertical tubes 44. The vertical tubes 44 extending upwards from the first horizontal tubes 42 communicate with second horizontal tube 46 having an opening facing towards the enclosed area 20.

Vertical tubes 44 have two ends. A first entrance end adjacent to the first horizontal tube 42, and a second exit end opening into and adjacent with the second horizontal tube 46.

Air rising through vertical tubes 44 is thus forced into the enclosed area 20 as illustrated by the arrow "A" in FIG. 2 through openings directed towards the enclosed area 20 from second horizontal tube 46.

Operationally, air discharged by blower 30 is delivered into air supply passages 40. Flow thereafter continues into first horizontal tubes 42 at the base of the enclosed area 20. The continued air movement through the first horizontal tube 42 forces air up through channels into the vertical tubes 44. This continued air flow of cool air through vertical tubes 44, keeps the outer surfaces 50 of vertical tubes 44 cool to the touch.

As air continues to flow upwards through vertical tubes 44, it is forced into a second horizontal tube 46 having an open face directed towards enclosed area 20. The combined movement of air from opposite sides of the enclosed areas 20 through the second horizontal tubes 46, forces the fire and smoke to remain within enclosed area 20. The air from the second horizontal tubes 46 on opposite sides of the enclosure 20, causes a circulatory drum shaped rotating current of air over the burning material within enclosure 20.

Figure 4:
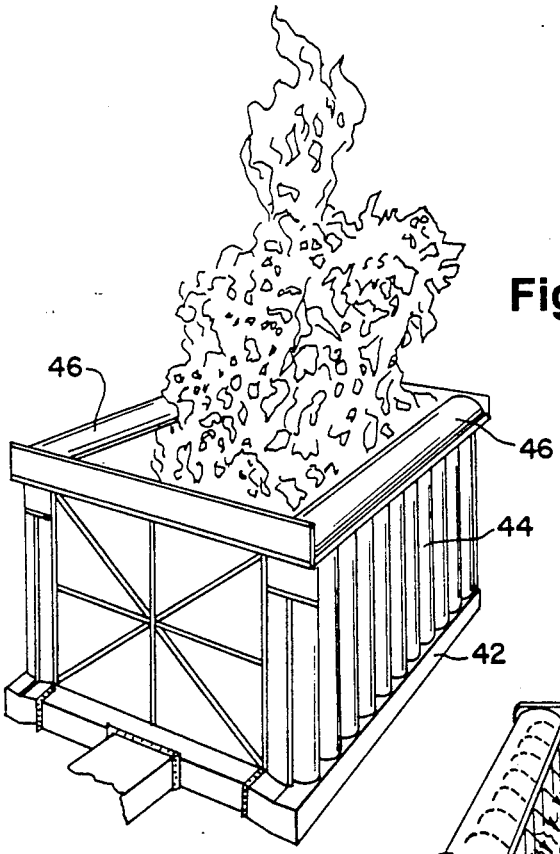
FIG. 4 is a top view of the refuse container of the present invention with the air stream not rising through the tubes.
Figure 5:
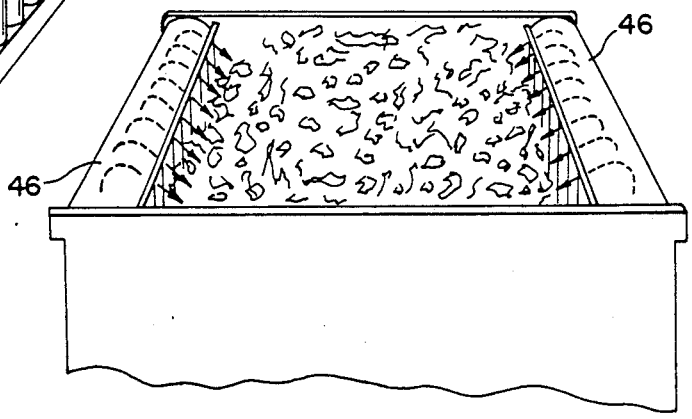
FIG. 5 is a top view of the refuse container of the present invention with the air stream rising through the tubes.

FIGS. 4 and 5 are used to illustrate the effects of the air flow upon an existing fire. In FIG. 4 the fire and smoke are unabated. Waste disposal as illustrated in FIG. 4 does not comply with strict environmental standards. FIG. 5 illustrates compliance with environmental standards and complete control of the fire and smoke.

Further, illustrated in FIG. 2 is shield 48 on the inside surface 49 of vertical tube 44. The shield 48 acts to prevent heat from crossing the vertical tubes 44. Thus, cool air continues in a constant flow through vertical tubes 44, allowing for reduced smoke and fly ash pollutants.

Blower 30 may be of any conventional design to maintain high fan efficiency. The blower 30 provides straight through non-turbulent airflow at an optimum rate. Of course, any conventional method may be used to reduce blower noise.

The inventive refuse container 10 creates and maintains a uniform curtain of air across the top of enclosed area 20 to contain smoke and other particulate matter. In addition, the continued air flow allows for increased combustion efficiency and the burning rate, because of increased oxygen being fed into the fire.

In the event one has a desire to observe the fire and disposal of waste material, a window 36 may be placed on those sides of the enclosed area 20 not having vertical tubes 44. Further, to ensure safety, a protective screen fence 38 may be placed about the complete outer surface of enclosed area 20. The purpose of the screen fence 38 is to ensure that no part of enclosed area 20 is open to the touch.

As previously described, the inventive refuse container for waste disposal 10 comprises a blower 30 operated by a motor 32 for forcing air through first horizontal tubes 42 into vertical tubes 44 and then into second horizontal tubes 46. Air exiting from the vertical tubes 44 into second horizontal tubes 46 forms an air curtain over any fire in enclosed area 20. This air curtain prevents smoke and ash pollutants from entering into the environment.

The inventive refuse container for waste disposal 10 has particular application where refuse such as wood, landscape waste and landscape debris is to be burned. The burning, due to the air curtain, is virtually smokeless, and approximately 95% of the original material disappears.

Various modes of carrying out the invention are contemplated as being within the scope of the following claims particularly point out and distinctly claiming the subject matter which is regarded as the invention.

I claim:

1. An above ground enclosure for burning refuse comprising first horizontal tubes at the base of and on at least two opposite sides of the enclosure, a plurality of vertical tubes opening into and extending upwards from said first horizontal tubes, said vertical tubes having an entrance end adjacent said first horizontal tube and an exit end opening into second horizontal tubes said second horizontal tubes having openings directed into said enclosure whereby cool air is directed from said first horizontal tube into said vertical tubes entrance end and is further directed from said vertical tube exit end into said second horizontal tube over said enclosure whereby an air curtain is formed over burning refuse and smoke and ash do not enter the environment.

2. The above ground enclosure for burning refuse of claim 1 including blower means communicating with said first horizontal tubes for inducing a flow of cool air through said horizontal and vertical tubes.

3. The above ground enclosure for burning refuse of claim 1 including means within said enclosed container adjacent the inner walls of said container for keeping the walls of the container cool.

* * * * *